US011988014B2

(12) United States Patent
Coenraets

(10) Patent No.: US 11,988,014 B2
(45) Date of Patent: May 21, 2024

(54) INFLATABLE SURFACE-COVERING DEVICE

(71) Applicant: BECOFLEX, Strepy-Bracquegnies (BE)

(72) Inventor: Benoît Coenraets, Strepy-Bracquegnies (BE)

(73) Assignee: BECOFLEX, Strepy-Bracquegnies (BE)

( * ) Notice: Subject to any disclaimer, the term of this patent is extended or adjusted under 35 U.S.C. 154(b) by 567 days.

(21) Appl. No.: 17/414,522

(22) PCT Filed: Dec. 12, 2019

(86) PCT No.: PCT/EP2019/084819
§ 371 (c)(1),
(2) Date: Jun. 16, 2021

(87) PCT Pub. No.: WO2020/126793
PCT Pub. Date: Jun. 25, 2020

(65) Prior Publication Data

US 2022/0049513 A1 Feb. 17, 2022

(30) Foreign Application Priority Data

Dec. 19, 2018 (BE) ..... 2018/5905

(51) Int. Cl.
*E04H 4/10* (2006.01)

(52) U.S. Cl.
CPC ..... *E04H 4/101* (2013.01); *E04H 4/105* (2013.01)

(58) Field of Classification Search
CPC ..... E04H 4/101; E04H 4/105
See application file for complete search history.

(56) References Cited

U.S. PATENT DOCUMENTS

RE25,078 E * 11/1961 McGuire ..... E04H 4/101 4/502
3,063,062 A 11/1962 Logan
3,277,498 A 10/1966 Kleinbard et al.
(Continued)

FOREIGN PATENT DOCUMENTS

GB 2379163 A 3/2003
WO 2014064138 A1 5/2014
WO 2014068131 A1 5/2014

OTHER PUBLICATIONS

Int'l Search Report for PCT/EP2019/084819, dated Mar. 16, 2020.

*Primary Examiner* — Erin Deery
(74) *Attorney, Agent, or Firm* — MaxGoLaw PLLC

(57) ABSTRACT

A device for covering a rectangular surface is provided that includes a cover (10) rotatably mounted on a drum (2), the device being capable of winding and unwinding the cover between an uncovered position and a covering position, rails (6) attached along the longitudinal sides of the surface, each of the rails includes an opening (6*o*) allowing the longitudinal edges (10L) of the cover to be locked in an air-tight manner, a blower system (51) suitable for blowing air (51*a*) into a volume under the cover and a flap (41) having an end (41*s*) which is sealed over a whole length of the second transverse side of the surface, a free end (41L) opposing the sealed end, such that the free end of the flap is in contact with the surface, the flap forming an air-tight seal between the cover and the surface along the second transverse side thereof.

14 Claims, 7 Drawing Sheets

(56) References Cited

U.S. PATENT DOCUMENTS

| | | | |
|---|---|---|---|
| 3,574,979 | A | 4/1971 | Chan |
| 9,546,492 | B2 | 1/2017 | Coenraets |
| 2015/0284969 | A1 | 10/2015 | Coenraets |

* cited by examiner

INFLATABLE SURFACE-COVERING DEVICE

FIELD OF THE INVENTION

The invention relates to a surface-covering device that is easy to implement and that best addresses the demands of the application concerned. The cover device is permanent in that the cover is permanently attached to a drum linked to the surface and that allows the cover to be wound and unwound in order to uncover or cover the surface. The cover device of the present invention allows, once the surface is covered by the cover, the volume contained between the surface and the cover to be pressurized, provoking the formation of a dome by the cover. The formation of a dome offers numerous advantages described in the following sections.

TECHNOLOGICAL BACKGROUND

Covers are applied to surfaces for reasons which depend on the nature of these surfaces. Thus, in the case of a pool such as a swimming pool, the cover can prevent pollution by leaves or animals, can save on energy, water and reagents and can or must ensure the safety of people, in particular of children. In a desalination pond or other fluid treatment ponds, a cover makes it possible to avoid liquid dilution due to rain or excessive evaporation due to heat.

When it is a sports court such as a clay or lawn outdoor tennis court, a cover makes it possible to protect against bad weather, and in particular intermittent rain.

In all the particular cases, an economical cover device is generally sought that allows for covering and uncovering that is easy, safe, reproducible and rapid, and that requires minimal human intervention.

Permanent devices for covering a surface that allow the surface to be covered and uncovered by the cover automatically using a motor, or semi-automatically, using a crank, are known. These permanent devices are characterized by a drum permanently linked to the surface and allowing the cover to be stowed away when the surface is uncovered. The covering of the surface is done easily by unwinding the cover from the drum. Two types of devices are distinguished: (1) the devices in which the drum is fixed to a first transverse side of the surface to be protected, and (2) the devices in which the drum is movable and is displaced over the surface to be protected. The present invention relates to both these types of devices.

In the devices comprising a drum fixed to a first transverse side of the surface to be protected, the cover is deployed by pulling it by a movable end with automatic traction means of rack or chain or traction cable type with or without a return pulley. The cover can possibly be guided by runners disposed on the longitudinal sides of the surface to be covered; the cover then slides over the surface in covering it. Likewise, when the cover is removed, it slides over the surface to be uncovered by being wound around the drum. This automatic cover device is illustrated notably in the following documents: U.S. Pat. Nos. 3,277,498, 3,574,979, GB 2 199 741, US 2005/0097834, CA 2,115,113, US 2001/0023506, U.S. Pat. Nos. 5,930,848 and 4,001,900.

The devices comprising a drum fixed to the transverse side of the surface have the major drawback of causing slippage of the cover which is dragged over the surface to be protected in its deployment and its removal, which creates premature wear and a greater work load to be supplied by a motor or a human being, due to the frictions thus generated.

The devices in which the drum is movable mitigate this drawback. The motorized drum is mounted on a longitudinal translation mechanism which displaces the drum over the surface to be covered which literally allows the cover to be "laid" on the surface, during its deployment, by unwinding it simultaneously from the drum during its longitudinal displacement, then lifting it, upon its removal, by simultaneously winding it onto the drum. The cover therefore does not slip on the surface either during its deployment or during its removal. The cover device also comprises a system for fixing the cover to a first transverse side of the surface to be covered such that the translation of the drum drives the rotation thereof and the unwinding or the winding of the cover above the surface to be covered. Examples of automatic or semi-automatic devices of this type are disclosed for example in the following documents: WO2005/026473, FR 2 900 951, DE 2 257 231, FR 2 893 651, FR 2 789 425, FR 2 803 769, FR 2 743 502, EP 1 719 858, FR 2 908 402 and BE 2008/0417/0418/0419.

The two types of devices with fixed or movable drum discussed above can comprise rails fixed parallel to the surface to be covered and comprising an opening allowing the first and second longitudinal edges of the cover to be locked over a length corresponding to the portion of cover covering the surface upon the unwinding or winding of the cover. Examples of such devices comprising a movable drum are described in WO2010010152 and WO2010054960.

In the present application, the terms "longitudinal", "transverse" and their derivatives refer respectively to the direction of displacement of the drum and to the direction of the axis of revolution thereof.

As illustrated in FIG. 1(*a*), a cover whose longitudinal edges are locked can be stretched taut on top of the surface. If the surface comprises a cavity, such as a swimming pool, such a cover offers the enormous advantage of thermally insulating the water from the environment, thus preventing the cooling of the water, if the atmosphere is colder than the desired temperature of the water (e.g. during the night) or preventing it from heating up, if the atmosphere is hotter than the desired temperature of the water (e.g. in hot southern countries).

A cover as illustrated in FIG. 1(*a*) does however have the drawback of always sagging a little under the effect of its own weight and above all under the effect of rainwater or snow which builds up on the outer surface of the cover. For this reason, such covers are generally provided with water evacuation holes distributed around the center of the cover. This has the drawback of cooling the water of the swimming pool, of altering its pH, and of introducing dirt therein, such as earth, leaves, insects, etc. Another drawback with such devices is that the significant tension applied to the cover and above all over its longitudinal edges, necessary to minimizing the bow at the center of the cover, necessitates a sophisticated mechanism.

Another type of device illustrated in FIG. 1(*b*), comprising rails locking the longitudinal edges of the cover, is such that the cover rests on the surface of the water. This type of device is advantageous if, in case of heat or significant solar radiation, the water of the swimming pool is heated up by conduction of the heat stored by the cover. This type of device is also advantageous in that it does not apply tensions to the cover. By contrast, if the atmosphere is colder than the desired temperature of the water, (e.g. during the night), such a device speeds up the cooling of the water of the swimming pool. Furthermore, if it has rained or snowed and water is deposited on the outer surface of the cover, it is very difficult to eliminate the water that has thus built up without mixing it with the water of the swimming pool.

Another cover device configuration is illustrated in FIG. 1(*c*) in which the cover forms a dome on top of the surface. This configuration is interesting in that it makes it possible to evacuate rainwaters to the outer edges of the swimming pool as they contact the outer surface of the cover. This configuration makes it possible to thermally insulate the water of the swimming pool from the atmosphere as in the case of the configuration illustrated in FIG. 1(*a*). It also has the advantage of applying only moderate tensions to the cover. It has the drawback of not allowing a good transfer of the temperature as in the case of floating covers illustrated in FIG. 1(*b*).

In the field of swimming pools, GB1307678 and FR2671125 have proposed inserting an inflated roll under the cover and floating on the surface of the water in order to form a dome or a vault. Since the roll has an out-of-water height greater than the height between the surface of the water and the edges of the swimming pool, the roll imposes an outward bulging of the cover. U.S. Pat. Nos. 4,048,678 and 4,825,479 propose welding flaps over the entire perimeter of the cover. The flaps have a free end immersed under the water level of the swimming pool. Air can then be injected under pressure to pressurize the free space between the surface of the water and the internal surface of the cover which thus forms a dome. U.S. Pat. No. 3,277,498 describes a cover device with fixed drum provided with rails in which the longitudinal edges of the cover slip during the deployments and removals of the cover and ensuring a sufficient tightness to allow the pressurization by blowing of air from the space contained under the cover. The motorization of this device is particularly complex.

Unfortunately, none of the solutions discussed for the cover to form a dome can be implemented in an automatic or semi-automatic permanent device, in which the cover is wound onto and unwound from a movable drum. It is clear that the presence of a roll, however perfectly deflated, would unacceptably increase the diameter of the drum when it is in uncovered position, with all of the cover wound thereon. It is also impossible to form a drum of reasonable diameter with a cover provided with a flap welded over the entire perimeter of the cover. Finally, while it is reasonably easy to guarantee a sufficient seal along the longitudinal edges of a cover inserted into rails in the case of a fixed drum, as described in U.S. Pat. No. 3,277,498, that does pose a problem when the cover is mounted on a movable drum, because the longitudinal edges of the cover must be introduced into the rails as the drum advances.

There is therefore still a need for a surface-covering system equipped with a movable drum that can be automated, that allows the cover to be stowed away when the surface is uncovered and which makes it possible to pressurize the volume contained between the surface and the cover when the surface is covered (="volume under the cover"). There also remains a need to combine the thermal advantages of a floating cover and those of a taut or inflated cover, according to the heating or cooling needs of the water contained in a swimming pool or a pond. These advantages and others described in the following sections are fulfilled by the present invention.

SUMMARY OF THE INVENTION

The invention is as defined in the main claim and preferred variants are defined in the dependent claims. The present invention notably comprises a device for covering a substantially rectangular surface delimited by first and second longitudinal sides linked to one another by first and second transverse sides, the device comprising, a cover which is substantially airtight and watertight and that allows the surface to be covered, the cover being delimited by first and second longitudinal edges that are substantially parallel and linked to one another by a movable end and by a static end fixed to the first transverse side in a substantially airtight manner, a drum that is rotatably mounted and capable of winding and unwinding the cover over its first and second longitudinal edges by displacement of the movable end of the cover along the first and second longitudinal sides of the surface, between, an uncovered position, in which the movable end is adjacent to the first transverse side, the surface not being covered by the cover, and a covering position, in which the movable end is adjacent to the second transverse side, the surface being thus covered by the cover, first and second rails fixed along the first and second longitudinal sides of the surface, each of the first and second rails comprising an opening allowing the first and second longitudinal edges of the cover to be locked in a substantially airtight manner over a length corresponding to the portion of cover covering the surface when the cover is unwound, wherein the static end (10*s*) of the cover is fixed to the surface (3) in an airtight manner along the first lateral edge and the movable end (10*m*) is fixed to an axle (2*a*) of the drum (2) which is mounted on a longitudinal translation mechanism, comprising a trolley (21) transversely overhanging the surface (3) to be covered and supporting the axle of the drum (2), said trolley (21) comprising, at each of its ends, at least two rollers (33) resting on the first and second rails (6) allowing the longitudinal translation of the trolley (21), a blower system capable of blowing air between the surface and an internal surface of the cover facing the surface when the movable end of the cover is in covering position, and a flap having a sealed end extending substantially parallel to, and over an entire length of, the second transverse side of the surface and mounted so as to follow the displacements of the movable end of the cover along the first and second longitudinal sides, and a free end opposite the sealed end, such that when the movable end is in covering position, the free end of the flap is in contact with the surface, and with its sealed end and its free end which is in contact with the surface, the flap forms an airtight seal between the cover and the surface along its second transverse side, allowing a substantially airtight volume to be defined between the surface and the internal surface of the cover when the movable end is in covering position and to create an overpressure in this volume by the blowing of air by the blower system.

The rails (6) can comprise a substantially U-shaped profile or a G-shaped profile, that is to say comprising a fin partially closing one side of the opening (6*o*) of the profile, or a C-shaped profile, that is to say comprising two fins partially closing each side of the opening (6*o*) of the rails.

The trolley can comprise, at each of its ends, a driving wheel disposed at a non-zero distance from the corresponding rail, on the same plane as, and between, the at least two rollers and whose axis of rotation is parallel to that of said drum. A belt which is flexible extends along each of the first and second rails, fixed only at each of its ends to first and second ends of the corresponding rail, and inserted into the opening of the corresponding rail in two sections of the belt lying between the first and second rollers and the first and second ends of the corresponding rail, and capping, without slip, the driving wheel in the section of the belt lying between the at least two rollers.

According to the invention, each rail (6) is preferably formed by a G-shaped or C-shaped profile with the opening (6*o*) oriented away from the surface, and with a fin situated on the side of the rail adjacent to the surface. Continuous insertion means allow the longitudinal edges of the cover to be inserted into the opening of each of the rails as the cover is unwound from the drum, and to be removed from the opening of each of the rails as the cover is wound onto the drum. Each longitudinal edge of the cover is provided with a bead which, by the combined action of the belt being incorporated into the rail and of the fin of the G-shaped or C-shaped profile, reversibly locks a longitudinal edge of the cover in the corresponding rail as the cover is unwound from the drum.

In one embodiment of the invention, the sealed end of the flap fixed to the internal surface of the cover by bonding and/or welding. Alternatively, the sealed end of the flap can be fixed to the axle of the drum. In these two configurations, the flap can have a width between its free and sealed ends lying between 150 and 600 mm, preferably between 200 and 500 mm, more preferably between 250 and 400 mm.

To facilitate the winding of the cover and of the flap, the device can comprise one or more tongues which are flexible and which link a portion of the flap, preferably adjacent to the free end of the flap, to a portion of the internal surface of the cover. The flap has a length equal to the length of the movable end of the cover and has a width measured normal to its length, and wherein the one or more tongues are distributed over the length of the flap. The tongues have a length measured between the flap and the internal surface of the cover which is shorter than the section of flap lying between its sealed end and the portion of the flap to which the tongue or tongues are fixed.

In another embodiment of the invention, the trolley and the drum are enclosed in a box comprising only one opening defined by a perimeter and extending over an entire length of the drum and facing the surface. The sealed end of the flap is fixed at least to a downstream or an upstream portion of the perimeter of the opening of the box, wherein "downstream" and "upstream" are defined in the direction of displacement of the movable end (10*m*) of the cover allowing the surface to be covered. The flap can have, in this embodiment of the invention, a width between its free and sealed ends lying preferably between 20 and 120 mm, preferably between 30 and 100 mm, more preferably between 40 and 70 mm.

The surface can comprise a cavity, preferably intended to be filled with water including a swimming pool, a potable water tank, or a pond containing aquatic animals, or a methanization tank, a tennis court, a pétanque court, or a curling court. The blower system can comprise an air outlet allowing air to be injected into the volume that is installed in a water draining gutter of a swimming pool, in a cavity of an edge of a swimming pool, on the cover, in a box or on an axle of the drum of a device.

The device can comprise a motor actuating the displacement of the movable end of the cover. Otherwise a crank can allow the displacement to be activated.

BRIEF DESCRIPTION OF THE FIGURES

These aspects and other aspects of the invention will be clarified in the detailed description of particular embodiments of the invention, reference being made to the drawings of the figures, in which.

DETAILED DESCRIPTION OF PARTICULAR EMBODIMENTS

Figure 1A:
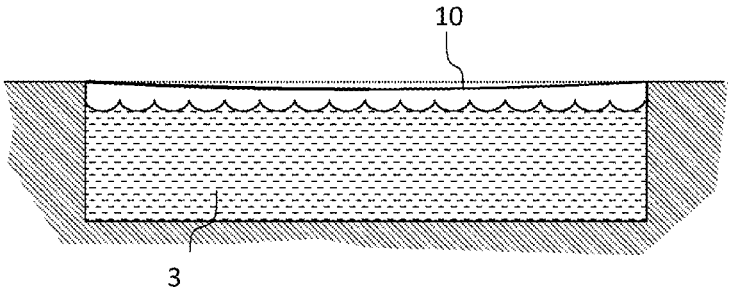
FIG. 1 represents three configurations (a)-(c) of cover devices that are taut, floating and inflated, and (d) and (e) represent two devices according to the present invention covering (d) a surface comprising a cavity and (e) a flat surface.
Figure 1B:
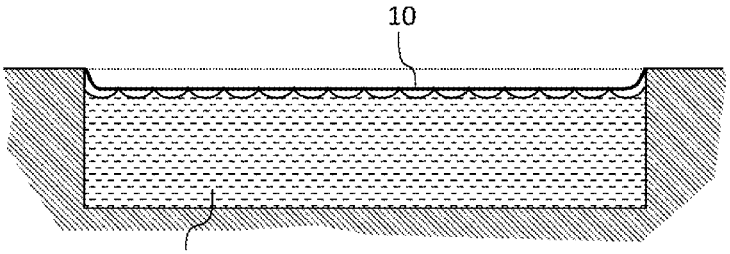
Figure 1C:
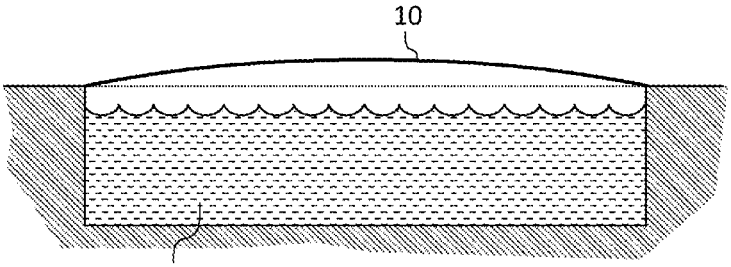
Figure 1D:
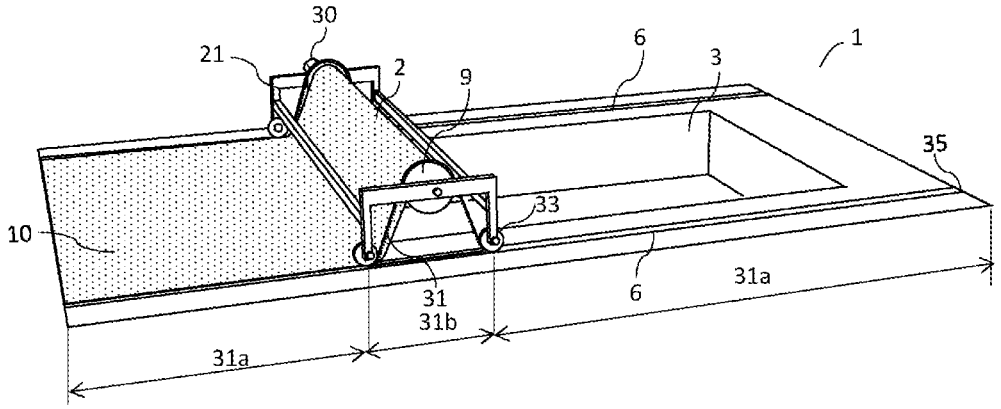
Figure 1E:
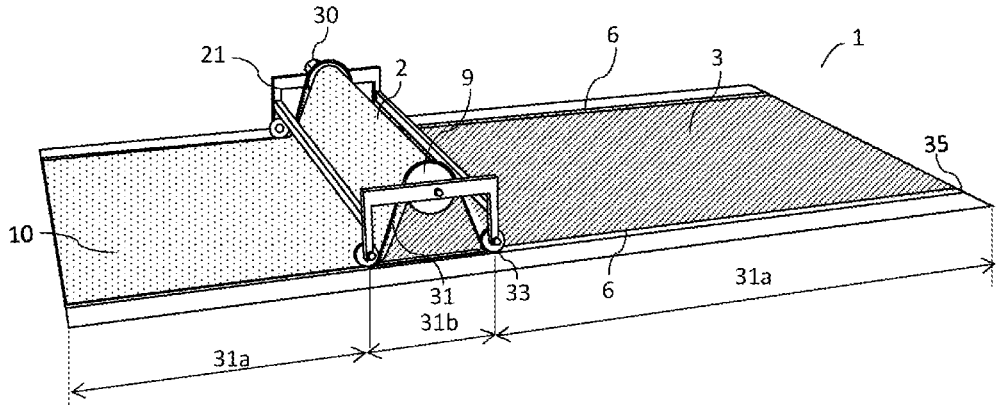

The device (1) of the present invention allows a substantially rectangular surface (3) delimited by first and second longitudinal sides linked to one another by first and second transverse sides to be covered and uncovered automatically or semi-automatically. The device comprises a cover (10) which is flexible and substantially airtight and watertight. It needs to have dimensions allowing the surface (3) to be covered. The cover is delimited by first and second longitudinal edges (10L) that are substantially parallel and linked to one another, on one side by a movable end (10*m*) and, on the other side, by a static end (10*s*) which is fixed to the first transverse side in a substantially airtight manner.

The device comprises a drum (2) that is rotatably mounted and capable of winding and unwinding the cover (10) along its first and second longitudinal edges (10L). The winding and unwinding of the cover is accompanied by a displacement of the movable end (10*m*) of the cover along the first and second longitudinal sides of the surface. The movable end can be displaced between two extreme positions: an uncovered position and a covering position. The uncovered position corresponds to a situation in which the cover is entirely wound onto the drum, with its movable end (10*m*) being adjacent to the first transverse side of the surface. As its name indicates, in this position of the movable end, the surface is not covered by the cover.

The covering position defines a configuration in which the surface is covered by the cover which is unwound from the drum. The movable end (10*m*) of the cover is adjacent to the second transverse side.

The device of the present invention comprises first and second rails (6) fixed along the first and second longitudinal sides of the surface. Each of the first and second rails comprises an opening (6*o*) allowing the first and second longitudinal edges (10L) of the cover to be locked in a substantially airtight manner over a length corresponding to the portion of cover covering the surface upon the unwinding of the cover.

Optimizing the blowing of air under the cover in order to form a dome when the movable end (10*m*) of the cover is in covering position and the surface (3) is covered by the cover requires a volume defined between the covered surface and an internal surface (10*i*) of the cover (="volume under the cover") to be substantially airtight from the atmosphere in contact with an outer surface of the cover. Thanks, on the one hand, to the static end (10*s*) of the cover, which is fixed to the first transverse side in a substantially airtight manner and, on the other hand, to the first and second longitudinal sides (10L) which are locked in a substantially airtight manner in the corresponding rails (6), the volume under the cover (10) is substantially airtight over three of the four sides of the surface. If a sufficient seal cannot be ensured on the second transverse side, the pressurization of the volume under the cover cannot be done satisfactorily, demanding too much power and enormous energy consumption. It is therefore essential to seal the fourth side (i.e. the second transverse side) of the surface. The sealing of the second transverse side, when the surface is covered by the cover (10), is ensured by a flap (41).

As illustrated in FIG. 4, the flap (41) comprises a sealed end (41*s*) extending substantially parallel to, and over an entire length of, the second transverse side of the surface. It is mounted so as to follow the displacements of the movable end (10*m*) of the cover along the first and second longitudinal sides (10L). The flap also comprises a free end (41L) opposite the sealed end (41*s*), such that, when the movable end (10*m*) is in covering position, the free end (41L) of the flap is in contact with the surface. Thus, with its sealed end (41*s*) and its free end (41L) which is in contact with the surface (3), the flap (41) forms an airtight seal between the cover and the surface along its second transverse side, making it possible to define the volume under the cover which is substantially airtight over all four sides of the cover when the movable end is in covering position.

With the device of the present invention allowing the volume defined under the cover to be rendered substantially airtight, the device can comprise a blower system (51) capable of blowing air (51*a*) into the volume under the cover contained between the surface (3) and the internal surface (10*i*) of the cover facing the surface (3) when the movable end of the cover is in covering position and thus create an overpressure in this volume causing the cover to dish and form a dome.

Movable Drum (2)

In a first preferred variant of the invention illustrated in FIGS. 1(*d*), 1(*e*), 2, 4(*a*) to 4(*c*), 5(*a*) and 5(*b*), and 6(*c*) to 6(*f*), the drum (2) is mounted on a longitudinal translation mechanism, comprising a trolley (21) transversely overhanging the surface (3) to be covered and supporting the drum (2). The static end (10*s*) of the cover is fixed to the surface (3) in an airtight manner along the first transverse edge. The movable end (10*m*) of the cover is fixed to an axle (2*a*) of the drum (2).

The trolley (21) comprises, at each of its ends, at least two rollers (33) resting on the first and second rails (6) allowing the longitudinal translation of the trolley (21) between the first and second transverse sides of the surface. The translation of the trolley can be activated by a cable or chain mounting, by a rack system as described in WO2010010152, or by other systems.

For example, in a preferred variant, described in detail in WO2010054960 and illustrated in FIGS. 1(*d*) and (*e*), the trolley (21) comprises, at each of its ends, a driving wheel (9) disposed at a non-zero distance from the corresponding rail (6), on the same plane as, and between, the at least two rollers (33) whose axis of rotation is parallel to that of said drum (2) and with which it forms a triangle. A belt (31) which is flexible extends along each of the first and second rails (6), fixed only at each of its ends to first and second ends (35) of the corresponding rail. Each belt is inserted into the opening (6*o*) of the corresponding rail in two sections (31*a*) of the belt (31) lying between the first and second rollers (33) and the first and second ends (35) of the corresponding rail, and capping, without slip, the driving wheel (9) in the section (31*b*) of the belt (31) lying between the at least two rollers (33). The rotation (by a motor or a crank) of the driving wheel (9) drives the translation of the trolley with respect to the belts which are fixed, and thus allows the trolley to be displaced longitudinally between the first and second transverse sides of the surface.

Figure 2A:
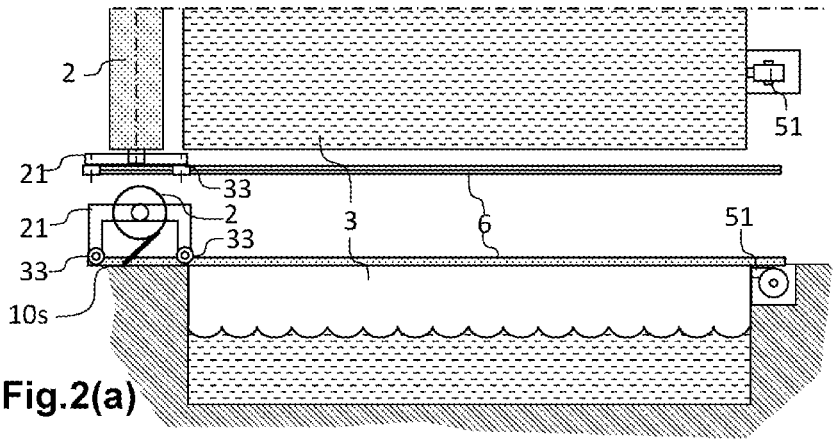
FIG. 2 represents a first preferred embodiment of the invention comprising a movable drum being displaced along the surface from (a) an uncovered position, passing through (b) a partially covered position, to (c) a covering position.
Figure 2B:
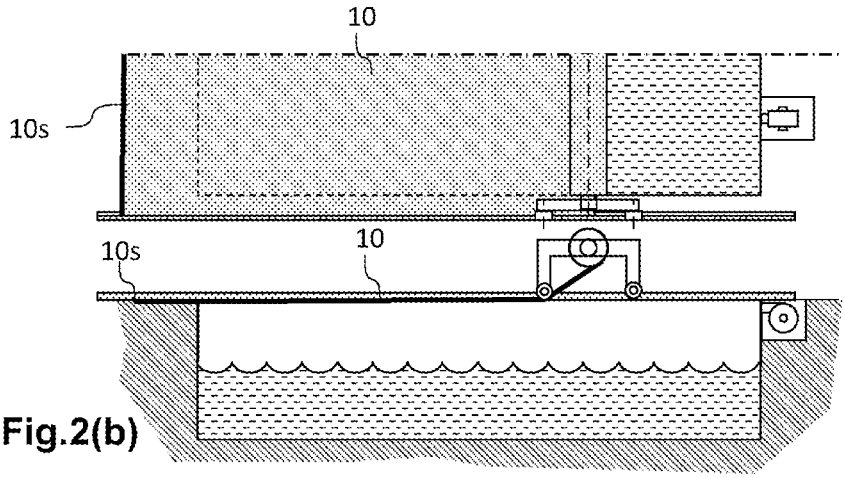
Figure 2C:
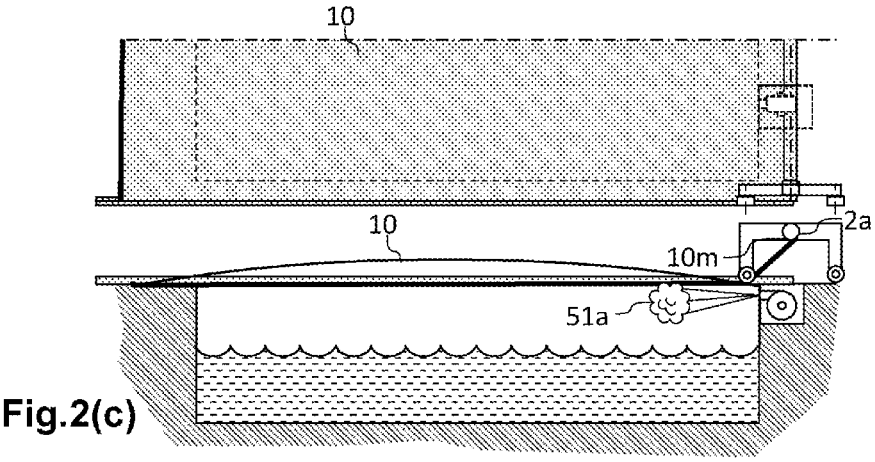

The displacement of the drum along the rails (6) is illustrated in FIG. 2, with top and profile cross-sectional views of the displacement of the drum and of the movable end (10*m*) of the cover from (a) the uncovered position, (b) between the uncovered and covering positions, and (c) to the covering position, in which the surface is covered by the cover. Air (51*a*) can then be blown under the cover to pressurize the volume under the cover and thus impart a dome form to the cover. With a movable drum, the cover is placed on the surface without friction. As the drum advances toward the second transverse side of the surface, the longitudinal edges (10L) are inserted and locked into the opening (6*o*) of the rails.

As illustrated in FIG. 5(*b*), each rail (6) is preferably formed by a G-shaped or C-shaped profile with the opening (6*o*) oriented away from the surface (3), and with the fin situated on the side of the rail (6) adjacent to the surface. Continuous insertion means allow the longitudinal edges (10L) of the cover to be inserted into the opening (6*o*) of each of the rails (6) as the cover (10) is unwound from the drum (2), and then to be removed from the opening of each of the rails (6) as the cover is wound onto the drum. Such means are described in detail for example in WO2017130053. As illustrated in FIG. 5(*b*), each longitudinal edge (10L) of the cover is provided with a bead (16) which, by the combined action of the belt (33) being incorporated into the rail (6) and of the fin of the G-shaped (or C-shaped) profile, reversibly locks a longitudinal edge (10L) of the cover in the corresponding rail as the cover is unwound from the drum.

Fixed Drum (2)

Figure 3A:
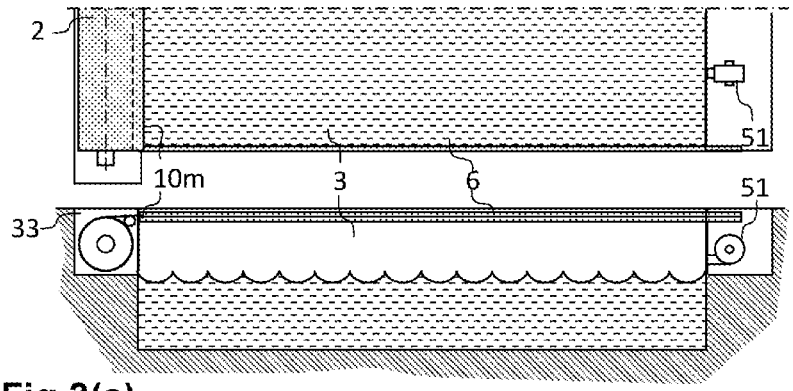
FIG. 3 represents a second embodiment not belonging to the invention comprising a fixed drum and the cover comprising a free and movable end that is displaced along the surface from (a) an uncovered position, passing through (b) a partially covered position to (c) a covering position.
Figure 3B:
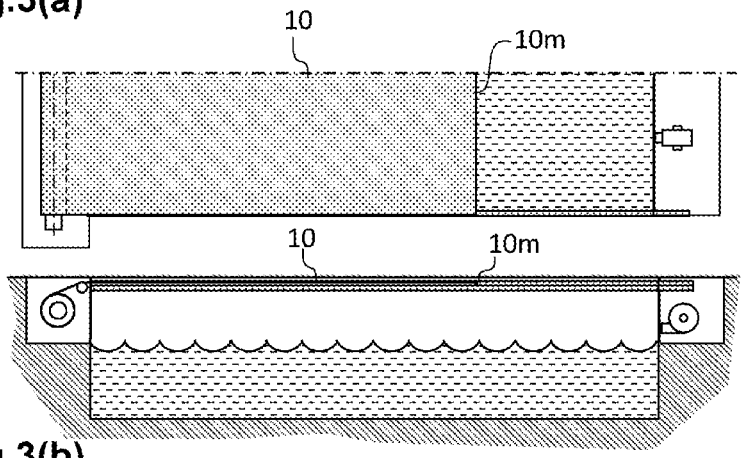
Figure 3C:
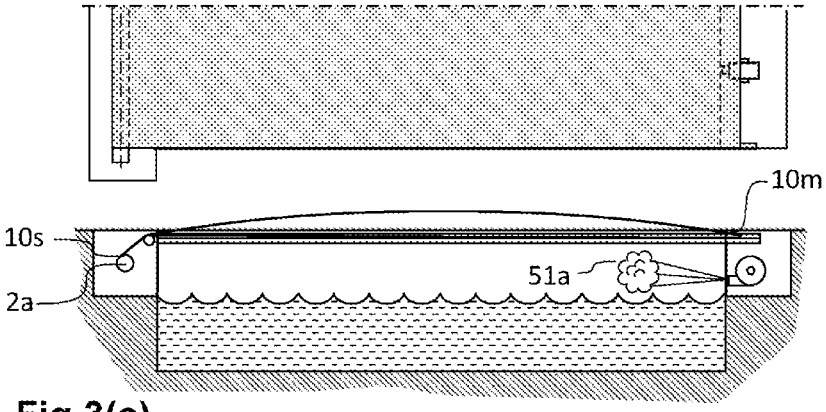
Figure 4A:
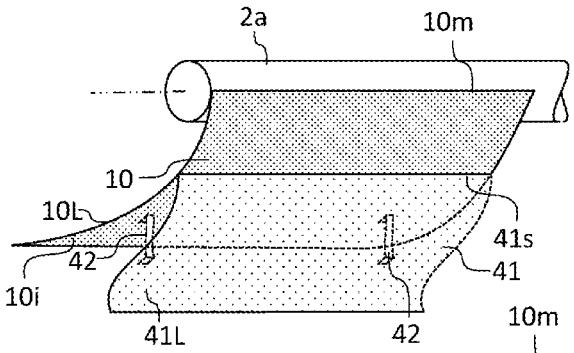
FIG. 4 represents different variants of flaps according to the present invention.
Figure 4B:
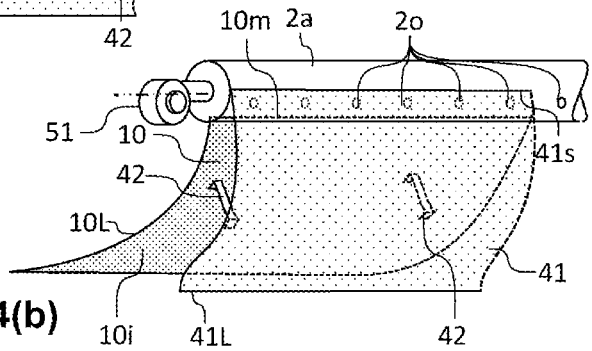
Figure 4C:
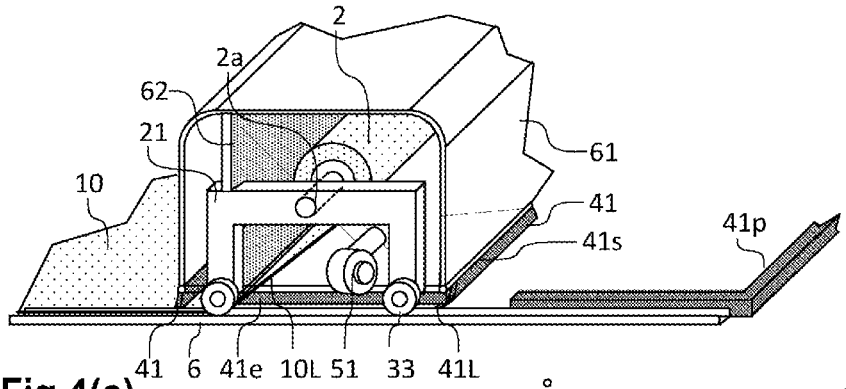
Figure 4D:
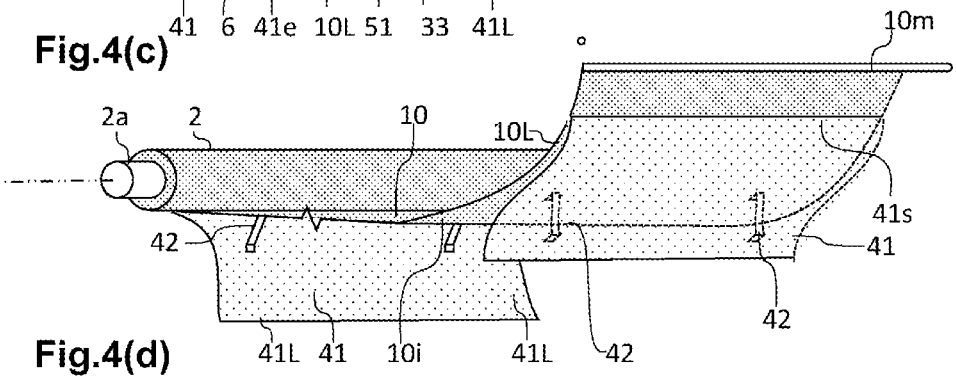
Figure 5A:
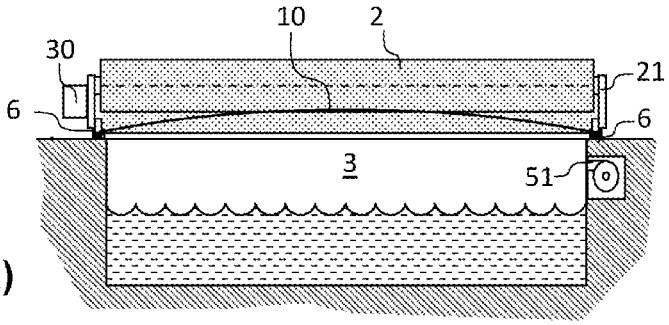
FIG. 5 represents different variants of rails and of systems for locking the longitudinal edges of the cover in a device comprising (a)&(b) a movable drum according to the invention and (c)&(d) a fixed drum according to the prior art.
Figure 5B:
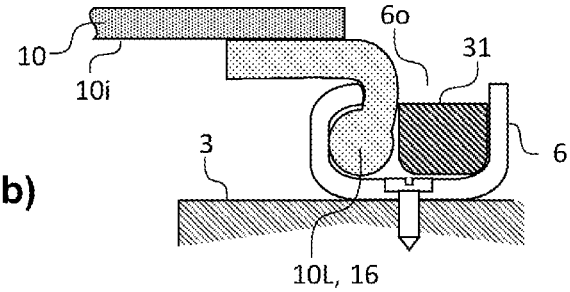
Figure 5C:
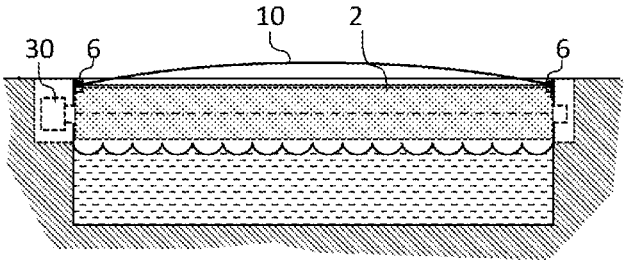
Figure 5D:
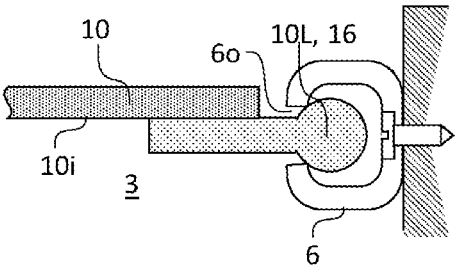
Figure 5E:
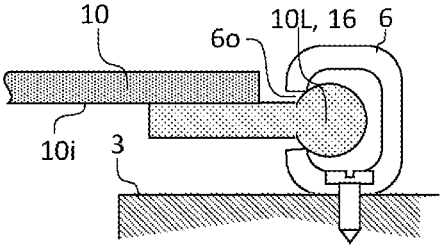
Figure 6A:
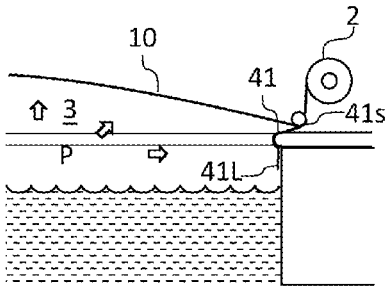
FIG. 6 represents different variants of flaps forming an airtight seal at the movable end of the cover.
Figure 6B:
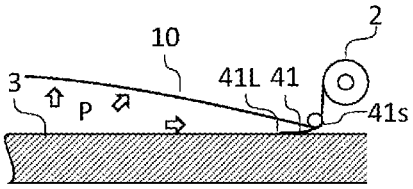
Figure 6C:
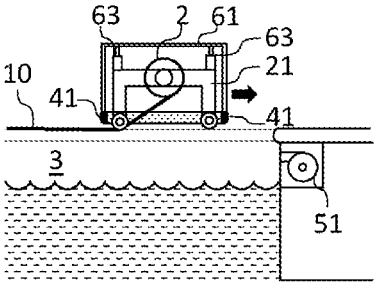
Figure 6D:
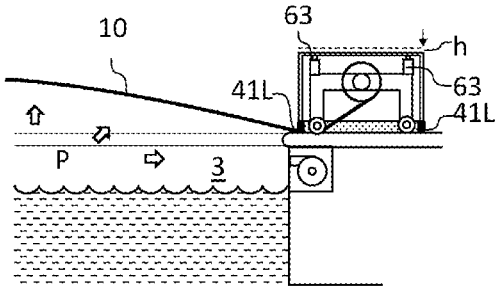
Figure 6E:
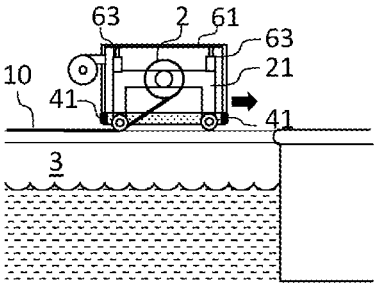
Figure 6F:
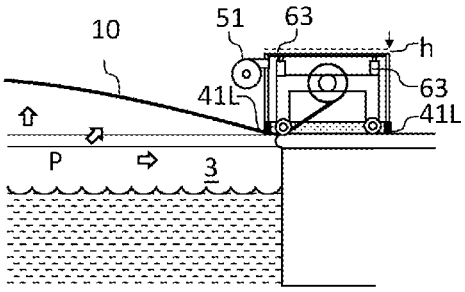

In another variant of the present invention illustrated in FIG. 3, the drum (2) is installed in a fixed manner, adjacent to the first transverse side of the surface (3). The static end (10*s*) of the cover (10) is fixed to an axle (2*a*) of the drum and the movable end (10*m*) of the cover is a free end. In a particularly esthetic variant, the drum can be installed in a chamber situated under the surface to be covered (if the latter is substantially horizontal), thus concealing the drum from view. The chamber can also be designed to be substantially airtight in order to render the volume under the cover airtight on the side of the first transverse side. Alternatively, as illustrated in FIG. 4(*d*), the drum (2) can be located above the surface to be covered (if the latter is horizontal) thus rendering it visible. Other measures are necessary to seal the volume under the cover (10) on the side of the first transverse side, which are discussed later.

The displacement of the movable end (10*m*) of the cover along the first and second longitudinal sides of the surface requires the use of a cable and pulley mounting to pull the movable end (10*m*) toward the second transverse edge of the surface and thus cover the surface. To uncover the surface, it is sufficient to rotate the drum on its longitudinal axis to return the movable end of the cover to the first transverse side of the surface.

The displacement of the movable end (10*m*) of the cover mounted on a fixed drum is not part of the present invention is illustrated in FIG. 3 for information, with top and profile cross-sectional views of the displacement of the movable end (10*m*) of the cover from (a) the uncovered position, (b) between the uncovered and covering positions, and (c) to the covering position, in which the surface is covered by the cover. Air (51*a*) can then be blown under the cover to pressurize the volume under the cover and thus impart a dome form to the cover.

As illustrated in FIGS. 5(*d*) and 5(*e*), the longitudinal edges (10L) can be provided with beads (16) inserted into rails (6) comprising a substantially C-shaped profile, that is to say one comprising two fins partially closing each side of the opening (6*o*) of the rails. As illustrated in FIGS. 5(*d*) and 5(*e*), the openings (6*o*) of the first and second rails (6) are preferably oriented opposite one another.

The Cover (10)

The cover (10) comprises first and second longitudinal edges (10L) that are parallel to one another and linked to one another by a movable end (10*m*) and by a static end (10*s*). The cover is preferably of substantially rectangular form, at least on three of its four sides, the static end (10*s*) or the movable end (10*m*) not necessarily being straight or normal to the longitudinal edges. Preferably, the cover is rectangular.

The cover must be flexible to allow it to be wound onto the drum and it must be made of a substantially airtight material. Preferably, the cover is made of polymer, for example a vinylic polymer, or is a fabric impregnated or covered with a layer of polymer.

The longitudinal edges (10L) of the cover (10) are preferably provided with a bead (16). Beads suitable for the device of the present invention are described for example in WO2014064138. The beads can be present over a longitudinal strip that is bonded, welded, and/or stitched to the cover, thus forming the longitudinal edges (10L) of the cover (see FIGS. 5(*b*), 5(*d*) and 5(*e*).

In the variant of a movable drum of FIGS. 1(*d*)&1(*e*) and 2 described above, the static end (10*s*) of the cover is fixed in a substantially airtight manner to the first transverse edge of the surface (3). In the case of a swimming pool, the static end can be fixed to the edge of the swimming pool. The movable end (10*m*) of the cover is fixed to an axle (2*a*) of the drum and is displaced in translation with the drum (2) mounted on the trolley (21).

In order to synchronize the speed of translation of the trolley with the speed of unwinding/winding of the cover from/onto the drum, the trolley (21) preferably comprises a translation axle inserted coaxially into the axle (2*a*) and linked to the latter by a spiral spring which is relaxed when the movable end (10*m*) is in uncovered position adjacent to the first transverse side of the surface and is taut when it is in covering position, adjacent to the second transverse side of the surface. The translation axle is linked to the driving wheel (9) and, for example, to a motor (30). The rotation of the translation axle allows the trolley to be displaced along the rails (6). Upon a displacement of the trolley to the second transverse edge of the surface, the tension applied to the cover by the distancing from the drum drives the rotation of the axle (2*a*) of the drum and the progressive tension of the spiral spring. At a constant translation speed of the trolley, the speed of rotation of the axle (2*a*) varies with the diameter of the drum and accelerates when the movable end (10*m*) approaches the second transverse side and the diameter of the drum decreases. In the reverse direction of uncovering of the surface, the taut spiral spring ensures the rotation of the axle (2*a*) during the translation of the trolley to the first transverse edge.

Other systems for synchronizing the speeds of rotation of the drum and of the motor are possible, for example by circumferential contact of two rotating rollers or by any other system known to the person skilled in the art as for example described in the documents FR 2893651, DE 2257231 or FR 2908402. It is also possible to use two motors, one revolving at constant speed and driving the longitudinal translation of the trolley and the second provided with a microprocessor controlling the speed of rotation of the drum according to its diameter.

The Rails (6)

The rails (6) are fixed along the first and second longitudinal sides of the surface and each comprise an opening (6*o*). The opening (6*o*) allows the corresponding longitudinal edge (10L) of the cover (10) to be locked. In the case of a movable drum, the rails also ensure the guiding of the displacement of the trolley (21) by interacting with the rollers (33).

The rails (6) preferably comprise a substantially U-shaped profile or a G-shaped profile, that is to say comprising a fin partially closing one side of the opening (6*o*) of the profile, or a C-shaped profile, that is to say comprising two fins partially closing each side of the opening (6*o*) of the rails.

The rails must not only lock the longitudinal edges of the cover as the cover covers the surface, but they must also ensure that this locking forms a substantially airtight contact between the longitudinal edges of the cover and the rails. For example, as illustrated in FIGS. 5(*b*), 5(*d*) and 5(*e*), the interaction of the bead (16) with the fins of the rail (6) and, in the case of FIG. 5(*b*), in collaboration with the belt (31) which is also housed in the opening of the rail in the portions (31*a*) of the longitudinal edges of the surface, ensures a substantially airtight contact.

The expression "substantially airtight" does not require a perfect seal. The production of a perfect seal would be illusory or very expensive to implement. The airtightness required in the present invention is such that the pressure losses in the volume under the cover make it possible, using a conventional blower device, to ensure an overpressure of at least 10 Pa, preferably at least 50 Pa, more preferably at least 70 Pa. The pressure must be sufficient to lift the weight of the cover (10). The person skilled in the art can determine the optimal trade-off between the cost to improve the sealing of the longitudinal edges in the rails and the energy consumption cost to maintain such a pressure under the cover. For example, with a pressure under the cover of 50 Pa, the air leaks are preferably less than 50 $m^3$/h, preferably less than 30 $m^3$/h and more preferably less than 20 $m^3$/h. A blower system (51) with an air flow rate (51*a*) of 100 to 300 $m^3$/h can be used, preferably between 150 and 250 $m^3$/h.

Flap (41)

In order to ensure a sealing of the volume under the cover at the second transverse side of the surface, the device of the present invention comprises a flap (41). The flap comprises a sealed end (41*s*) extending substantially parallel to, and over an entire length of, the second transverse side of the surface, and is mounted so as to follow the displacements of the movable end (10*m*) of the cover along the first and second longitudinal sides (10L). It also comprises a free end (41L) opposite the sealed end (41*s*). When the movable end (10*m*) is in covering position, the free end (41L) of the flap is in contact with the surface.

In a preferred variant of the invention illustrated in FIGS. 4(*a*)&4(*d*), the sealed end (41*s*) of the flap (41) can be fixed to the internal surface (10*i*) of the cover (10) by bonding and/or welding. The sealed end (41*s*) of the flap (41) is preferably adjacent to the movable end (10*m*) of the cover or, in any case, is substantially closer to the movable end (10*m*) than the fixed end (10*s*).

Alternatively, as illustrated in FIG. 4(*b*), the sealed end (10*s*) of the flap can be fixed to the axle (2*a*) of the drum.

In the preceding two variants illustrated in FIGS. 4(*a*), 4(*b*)&4(*d*), the flap (41) can have a width between its free (41L) and sealed (41*s*) ends preferably lying between 150 and 600 mm, preferably between 200 and 500 mm, more preferably between 250 and 400 mm, dependent on the dimensions of the surface. The width of the flap must allow the flap to form an airtight seal between the cover and the surface along its second transverse side, between its sealed end (41*s*) and its free end (41L) which is in contact with the surface (3). Since the volume under the cover is thus substantially airtight along the four sides of the surface (3), the volume under the cover can then be pressurized by the blowing of air by the blower system (51).

In a third variant illustrated in FIG. 4(*c*), the trolley (21) and the drum (2) are enclosed in a box (61) comprising only one opening defined by a perimeter and extending over an entire length of the drum and facing the surface (3). The sealed end (41*s*) of the flap (41) is fixed at least to a downstream or upstream portion of the perimeter of the opening of the box. The terms "downstream" and "upstream" are defined in the direction of displacement of the movable end (10*m*) of the cover allowing the surface to be covered. The flap (41) can have a width between its free (41L) and sealed (41*s*) ends lying preferably between 20 and 120 mm, preferably between 30 and 100 mm, more preferably between 40 and 70 mm.

In a variant illustrated in FIGS. 6(*c*) to 6(*f*), the box can comprise means for varying the distance h separating the surface (3) from the perimeter of the opening of the box. Such an arrangement is described for example in WO2014068131. The distance can be varied using jacks (63), preferably electrical, or levers, or worm screws. The position of the box can thus be varied in a direction normal to the plane containing the perimeter of the surface (3) between a translation position, in which the perimeter of the opening of the box, including the flap, is not in contact with the surface, and a contact position, in which the perimeter of the opening of the box contacts the surface and forms therewith a substantially airtight contact. In this variant, it is preferable for the flap (41) to extend over the entire perimeter of the opening of the box (61). The flap must ensure an airtight seal of the volume contained in the box when the latter is in contact position.

In the case where the surface comprises a cavity such as a swimming pool for example, the covering position of the drum can be defined as illustrated in FIG. 6(*d*) such that the entire perimeter of the opening of the box is outside of the cavity, for example on the edge of a swimming pool. The volume under the cover can then be pressurized as far as the flap (41) situated on an upstream portion of the perimeter of the opening of the box. In this case, the volume under the cover is separated from the volume in the box and it is preferable to install the blower system outside of the box, for example on the cover or in a wall defining the cavity of the surface (3).

If, however, as illustrated in FIG. 6(*f*), in the covering position of the drum, the upstream portion of the box overhangs the cavity, the volume under the cover is fluidically connected with the volume in the box, and the blower system can be provided on or in the box (see FIGS. 4(*b*), 4(*c*), 6(*e*) and 6(*f*). The blower system can also preferably be mounted on the axle (2*a*) of the drum, the interior of which is hollow and whose walls are provided with openings (2*o*) distributed over the length of the axle.

In another variant, the box cannot vary its distance h from the surface. In this case, the flap must ensure the sealing of the box at least in the covering position of the drum. In addition to the downstream portion of the perimeter of the box provided with a flap, the longitudinal portions of the perimeter of the opening must also be sealed, for example with lateral flaps (41*e*) also extending along the longitudinal portions, and whose free ends contact the surface during the displacements of the trolley (21). As illustrated in FIG. 4(*c*), in order to reduce the wear of the flaps, the surface can be provided, on its second transverse side, with a counter-sealing system which, in collaboration with the flap (41) and with the lateral flaps (41*e*), makes it possible to form a seal when the drum is in covering position. Thus, the flaps (41, 41*e*) of the box must not touch the surface during the displacement of the trolley, thus notably reducing the wear of the flaps.

The upstream portion of the trolley can also be provided with a flap or a seal. If necessary, the internal volume of the box can be compartmentalized with a separating wall (62) which, in certain configurations, makes it possible to simplify the sealing of the box on the upstream part of the perimeter of the opening, where the cover meets the surface.

Above all, but not solely, in the case of a movable drum, it is important, during the rewinding of the cover onto the drum when uncovering the surface, for the flap not to fold uncontrollably, thus increasing the diameter of the drum in uncovered position and, above all, preventing, during a subsequent covering of the surface, the flap from being positioned correctly when the movable end (10*m*) of the cover is in covering position. If the flap is badly positioned and its free end does not correctly contact the surface, the seal that is sought may be lost. To avoid this problem and as illustrated in FIGS. 4(*a*), 4(*b*) and (4*d*), it is preferable for the device to comprise one or more tongues (42) distributed over the length of the flap, which are flexible and which link a portion of the flap (41), preferably adjacent to the free end (41L) of the flap, to a portion of the internal surface (10*i*) of the cover (10). The tongues have a length measured between the flap (41) and the internal surface (10*i*) of the cover which is shorter than the section of flap contained between its sealed end (41*s*) and the portion of the flap to which the tongue or tongues are fixed. Thus, the flap is always presented with a good orientation when the cover is rewound onto the drum, rendering the mechanism more reproducible.

If necessary, as illustrated in FIG. 4(*d*), a second flap can be sealed to the internal surface (10*i*) of the cover on the side of the static end (10*s*) of the cover. Such an "upstream" flap may be necessary if it is difficult to ensure the sealing of the volume under the cover on the first transverse side.

Blower System (51)

The blower system can comprise one or more blowers (51) installed such that an air outlet allows air (51*a*) to be injected into the volume under the cover which is substantially airtight over the entire perimeter of the surface (3). Blowers as available on the market can be used, the power of which depends on the capacity of the volume under the cover and on the quality of the seal over the four sides of the surface. In most cases, a flow rate of 70 to 400 $m^3/h$, preferably between 100 and 300 $m^3/h$, more preferably between 150 and 250 $m^3/h$ can be applied to form a dome.

The blower system can be located in a water draining gutter of a swimming pool, in a cavity of an edge of a swimming pool (see FIGS. 2&3), on the cover (10), in or on a box (61), or on an axle (2*a*) of the movable drum. In order to be able to install a device according to the present invention on existing surfaces of any size and any configuration, it is preferable to be able to install the blower system on the device itself. For example, on the box (61) of a movable drum (see FIGS. 4(*c*), 6(*e*) and 6(*f*)), in a hollow axle (2*a*) of a movable or fixed drum (see FIG. 4(*b*)) or on the cover. A blower system installed on the hollow axle (2*a*) defining a cavity is preferred. The axle comprises orifices (2*o*) distributed along the axle, fluidically linking the cavity with an outside of the axle and contained between the sealed end (41*s*) of the flap and the movable end (10*m*) of the cover.

Advantages of the Present Invention

A cover device according to the present invention can be used to cover different types of surfaces, such as tennis courts, curling courts, pétanque courts, a skating rink, etc. The surface to be covered can also comprise a cavity, preferably intended to be filled with water, including a swimming pool, a potable water tank, or a pond comprising aquatic animals, or a methanization ditch.

The fact that the volume under the cover can be pressurized by the blowing of air by a blower system (51) makes it possible to impart a dome form to the cover (10), separating the cover from the covered surface. The dome form prevents rainwater from accumulating on the outer surface of the cover (10) and from causing sagging at its center. A significant proportion of this accumulated water finally ending up entering into contact with the surface, either by flowing through discharge orifices applied to the cover to avoid the formation of a pocket of water, or by uncovering the surface by the winding of the cover onto the drum. With the dome form, the rainwater flows by runoff to the periphery of the surface by gravity.

In the case of a curling track or a skating rink, the dome form isolates the iced surface from the atmosphere which, if it is at a temperature higher than 0° C., would result in higher energy demands to maintain the temperature of the ice below 0° C.

In the case of swimming pools, the present invention is particularly advantageous, because it allows a dome to be formed with the cover, as illustrated in FIG. 1(*c*) by pressurizing the volume under the cover, but also allows a floating cover to be formed as illustrated in FIG. 1(*b*), depending on whether the wish is to thermally isolate the water of the swimming pool from the ambient atmosphere (e.g., if the ambient temperature is lower than the desired temperature of the water) or, on the contrary, if the wish is to form a thermal bridge between the water of the swimming pool and the surrounding atmosphere (e.g. if the sun illuminates the cover and there is a desire to raise the temperature of the water. The pressure under an inflated cover can be reduced rapidly by displacing the movable end (10*m*) of the cover so as to break the seal on the second transverse side. Alternatively, the device can comprise a depressurization valve which can be opened to reduce the pressure under the cover and allow it to rest on the surface of the water.

By pressurizing the volume under the cover only when the movable end (10*m*) is in covering position, it is possible to have the longitudinal edges (10L) slide into the rails (6) during the displacement of the movable end without the cover being taut as illustrated in FIG. 1(*a*). This makes it possible to extend the life of the beads (16) of the longitudinal edges of the cover (10).

Finally, when the cover forms a dome, the outer surface of the cover is perfectly smooth and gives a superior esthetic appearance.

| # | Feature |
|---|---|
| 1 | Cover device |
| 2 | Drum |
| 2a | Axle of the drum (3) |
| 2o | Air opening in the axle (2a) |
| 3 | Cover |
| 6 | Rail |
| 6o | Opening of the rail |
| 9 | Driving wheel |
| 10 | Cover |
| 10i | Internal surface of the cover |
| 10L | Longitudinal edge of the cover |
| 10m | Movable end of the cover |
| 10s | Static end of the cover |
| 16 | Bead |
| 21 | Trolley |
| 30 | Motor |
| 31 | Belt |
| 31a | Portion of belt (31) excluding the portion (31b) contained between the rollers (33) |
| 31b | Portion of belt (31) contained between the rollers (33) |
| 33 | First and second rollers |
| 35 | End of a belt |
| 41 | Flap |
| 41e | Lateral sealing of the box |
| 41L | Free end |
| 41p | Sealing station in covering position |
| 41s | Sealed end |
| 42 | Tongue |
| 51 | Blower device |
| 61 | Box |
| 62 | Internal sealing wall |
| 63 | Pistons for varying the height of the box |

The invention claimed is:

1. A device (1) for covering a substantially rectangular surface (3) delimited by first and second longitudinal sides linked to one another by first and second transverse sides, the device comprising, a cover (10) which is substantially airtight and watertight and that allows the surface (3) to be covered, the cover being delimited by first and second longitudinal edges (10L) that are substantially parallel and linked to one another by a movable end (10*m*) and by a static end (10*s*) fixed to the first transverse side in a substantially airtight manner, a drum (2) that is rotatably mounted and capable of winding and unwinding the cover (10) over the first and second longitudinal edges (10L) by displacement of the movable end (10*m*) of the cover along the first and second longitudinal sides of the surface, between, an uncovered position, in which the movable end (10*m*) is adjacent to the first transverse side, the surface not being covered by the cover, and a covering position, in which the movable end (10*m*) is adjacent to the second transverse side, the surface being thus covered by the cover, first and second rails (6) fixed along the first and second longitudinal sides of the surface, each of the first and second rails comprising an opening (6*o*) allowing the first and second longitudinal edges (10L) of the cover to be locked in a substantially airtight manner over a length corresponding to the portion of cover covering the surface when the cover is unwound, wherein the static end (10*s*) of the cover is fixed to the surface (3) in an airtight manner along the first lateral edge and the movable end (10*m*) is fixed to an axle (2*a*) of the drum (2) which is mounted on a longitudinal translation mechanism, comprising a trolley (21) transversely overhanging the surface (3) to be covered and supporting the axle of the drum (2), said trolley (21) comprising, at each end, at least two rollers (33) resting on the first and second rails (6) allowing the longitudinal translation of the trolley (21), characterized in that the device comprises a blower system (51) capable of blowing air (51*a*) between the surface and an internal surface (10*i*) of the cover facing the surface (3) when the movable end of the cover is in covering position, and a flap (41) having a sealed end (41*s*) extending substantially parallel to, and over an entire length of, the second transverse side of the surface and mounted so as to follow the displacements of the movable end (10*m*) of the cover along the first and second longitudinal sides (10L), and a free end (41L) opposite the sealed end (41*s*), such that when the movable end (10*m*) is in covering position, the free end (41L) of the flap is in contact with the surface, and in that, with the sealed end (41*s*) and the free end (41L) which is in contact with the surface (3), the flap (41) forms an airtight seal between the cover and the surface along its second transverse side, allowing a substantially airtight volume to be defined between the surface and the internal surface of the cover when the movable end is in covering position and to create an overpressure in the volume by the blowing of air by the blower system (51).

2. The device as claimed in claim 1, wherein each rail (6) comprises a substantially U-shaped profile or a G shaped profile, comprising a fin partially closing one side of an opening (6*o*) of the profile, or a C-shaped profile comprising two fins partially closing each side of an opening (6*o*) of the rail.

3. The device as claimed in claim 1, wherein (a) the trolley (21) comprises, at each end, a driving wheel (9) disposed at a non-zero distance from the corresponding rail (6), on the same plane as, and between, the at least two rollers (33) and whose axis of rotation is parallel to that of said drum (2), (b) a belt (31) which is flexible extends along each of the first and second rails (6), fixed only at each of its ends to first and second ends (35) of the corresponding rail, and inserted into the opening (6*o*) of the corresponding rail in two sections (31*a*) of the belt (31) lying between the first and second rollers (33) and the first and second ends (35) of the corresponding rail, and capping, without slip, the driving wheel (9) in the section (31*b*) of the belt (31) lying between the at least two rollers (33).

4. The device as claimed in claim 2, wherein each rail (6) is formed by the G-shaped or C shaped profile with the opening (6*o*) oriented away from the surface (3), and with the one fin of the G-shaped profile situated on the side of the rail (6) adjacent to the surface, continuous insertion means allow the longitudinal edges (10L) of the cover to be inserted into the opening (6*o*) of each of the rails (6) as the cover (10) is unwound from the drum (2), and to be removed from the opening of each of the rails (6) as the cover is wound onto the drum, each longitudinal edge (10L) of the cover is provided with a bead (16) which, by the combined action of the belt being incorporated into the rail (6) and of the fin of the G-shaped profile, reversibly locks a longitudinal edge (10L) of the cover in the corresponding rail as the cover is unwound from the drum.

5. The device as claimed in claim 1, wherein the flap (41) has a width between the free (41L) and sealed (41*s*) ends lying between 150 and 600 mm.

6. The device as claimed in claim 1, wherein the sealed end (41*s*) of the flap (41) is fixed to the internal surface (10*i*) of the cover (10) by bonding and/or welding.

7. The device as claimed in claim 1, wherein the sealed end (10*s*) of the flap is fixed to the axle (2*a*) of the drum.

8. The device as claimed in claim 1, comprising one or more tongues (42) which are flexible and which link a portion of the flap (41) to a portion of the internal surface (10*i*) of the cover (10), wherein the flap has a length equal to the length of the movable end (10*m*) of the cover and has a width measured normal to its length, and wherein the one or more tongues are distributed over the length of the flap, and have a length measured between the flap (41) and the internal surface (10*i*) of the cover which is shorter than the section of flap lying between the sealed end (41*s*) and the portion of the flap to which the one or more tongues are fixed.

9. The device as claimed in claim 1, wherein the trolley (21) and the drum (2) are enclosed in a box (61) comprising only one opening defined by a perimeter and extending over an entire length of the drum and facing the surface (3), wherein the sealed end (41*s*) of the flap (41) is fixed at least to a downstream or upstream portion of the perimeter of the opening of the box, and wherein the flap (41) has a width between the free (41L) and sealed (41*s*) ends.

10. The device as claimed in claim 9, wherein the drum (2) comprises a hollow axle (2*a*) provided with a cavity, and orifices (2*o*) are distributed along the axle, fluidically linking the cavity with an outside of the axle and contained between the sealed end (41*s*) of the flap and the movable end (10*m*) of the cover, and wherein the blower device (51) is linked by fluidic connection to the cavity of the axle.

11. The device as claimed claim 9, wherein the flap (41) has a width between the free (41L) and sealed (41*s*) ends lying between 20 and 120 mm.

12. The device as claimed in claim 1, wherein the blower system (51) comprises an air outlet allowing air (51*a*) to be injected into the volume that is installed in one of the group consisting of: a water draining gutter of a swimming pool, in a cavity of an edge of a swimming pool, on the cover (10), and on an axle (2*a*) of the drum of the device of claim 3.

13. The device as claimed in claim 1, comprising a motor (30) actuating the displacement of the movable end (10*m*) of the cover.

14. The device as claimed in claim 1, wherein the surface comprises a cavity selected from the group consisting of a swimming pool, a potable water tank, and a pond containing aquatic animals, a tennis court, a pétanque court, or a curling court.

* * * * *